US005623831A

United States Patent [19]

Mesher

[11] Patent Number: 5,623,831

[45] Date of Patent: Apr. 29, 1997

[54] FLUIDIZED PARTICLE PRODUCTION SYSTEM AND PROCESS

[76] Inventor: Terry Mesher, 176 Little Eldon Place, Victoria, British Columbia, Canada, V8Z 1E3

[21] Appl. No.: 435,432

[22] Filed: May 10, 1995

[51] Int. Cl.[6] ..... F25C 5/02; A23G 9/00

[52] U.S. Cl. ..... 62/71; 62/320; 62/346

[58] Field of Search ..... 62/71, 320, 346, 62/354, 321; 451/75, 99; 241/DIG. 17

[56] References Cited

U.S. PATENT DOCUMENTS

| | | | |
|---|---|---|---|
| 2,063,770 | 12/1936 | Taylor . | |
| 2,308,541 | 1/1943 | Raver . | |
| 2,431,278 | 11/1947 | Raver . | |
| 2,549,215 | 4/1951 | Mansted . | |
| 2,687,623 | 8/1954 | Aubrey . | |
| 2,733,577 | 2/1956 | Rothe . | |
| 2,749,722 | 6/1956 | Knowles . | |
| 3,246,481 | 4/1966 | Douglas et al. | 62/320 |
| 3,762,181 | 10/1973 | Leidig | 62/320 |
| 4,354,360 | 10/1982 | Fiske | 62/320 |
| 5,257,510 | 11/1993 | Cox | 62/346 |
| 5,367,838 | 11/1994 | Visaisouk et al. | 451/39 |
| 5,394,705 | 3/1995 | Torii et al. | 62/320 X |

FOREIGN PATENT DOCUMENTS

| | | | |
|---|---|---|---|
| 1321478 | 8/1993 | Canada . | |
| 2097222 | 12/1993 | Canada . | |
| 2111648 | 6/1994 | Canada . | |
| 2113291 | 7/1994 | Canada . | |
| 2121268 | 10/1994 | Canada . | |
| 2165727 | 8/1973 | France . | |
| 159414 | 7/1957 | Sweden | 62/346 |
| 344744 | 4/1960 | Switzerland . | |
| 9104449 | 4/1991 | WIPO . | |
| 9416861 | 8/1994 | WIPO . | |

*Primary Examiner*—Christopher Kilner
*Attorney, Agent, or Firm*—Brian M. Long

[57] ABSTRACT

A fluidized particle production system includes a solidifying unit having a forming surface for supporting a solidified layer of a medium, e.g. ice and a treatment apparatus for removing the solidified medium from the solidifying surface and sizing the removed solidified medium into particles of desired dimensions. The treatment apparatus comprising a sizing device co-operating and moving with the solidifying surface for effecting therebetween the sizing of the particles. A housing encloses the solidifying unit and the treatment apparatus and a sweep fluid outlet is positioned to discharge sweep fluid towards the sizing device for fluidizing the particles and transporting the fluidized particles through an outlet duct from the housing.

13 Claims, 5 Drawing Sheets

FLUIDIZED PARTICLE PRODUCTION SYSTEM AND PROCESS

BACKGROUND OF THE INVENTION

1. Field of the Invention

The present invention relates to fluidized particle production systems and processes for producing fluidized particles and is useful in particular, but not exclusively, for the production of fluidized ice particles for ice blasting.

2. Description of the Related Art

Several systems have been devised to carry out one or more functions of ice formation and removal, and ice particle formation and transport. The removal or harvesting of ice from ice forming surfaces of ice making units has been carried out by various methods, including melting, the use of gravity, scrapers, or other mechanical means and a combination of the above, some of which are described in U.S. Pat. Nos. 2,344,922; 2,995,017; 4,389,820; 4,707,951 and 4,965,968. Ice particle formation has been carried out by scraping or harvesting (U.S. Pat. No. 2,344,922) or other methods involving grinding or crushing. Induction, gravity and mechanical feed technologies have been used to facilitate ice particle transport in U.S. Pat. Nos. 4,707,951; 4,389,820; 2995,017; 2,344,922; 4,965,968 and 2,724,949.

Batch atmospheric or "pressure pot" systems are known and used for relatively non-degradable media wherein a pre-manufactured medium is loaded in batches into a holding vessel for subsequent treatment such as sizing of particles, agitation and dispensing for transport. Such systems may be simplified and improved in terms of capital and operational costs and complexity by continuous or semi-continuous systems.

There are inherent problems in existing partially sealed continuous systems, especially those used for particle transport and blast treatment. These systems use a purge medium of air or other gas, e.g. carbon dioxide, in order to prevent humidity and heat intrusion, and to minimize icing, agglomeration and fluidization difficulties. It is also desirable to be able to quickly stop and start the systems between continuous running.

Such purging, with the associated capital, production and operational costs, is one of the most costly items in the system. Without total effective sealing, its practical use is wasteful. Costs may be reduced by minimizing the volume required, and by maximizing its usage.

Prior art systems attempt to isolate particle production from treatment which comprises conditioning, including sizing, cooling and drying, and also from transport of the particles. This requires costly and complicated equipment and delicate balance of control between process unit operations.

The present invention may be most immediately employed in systems which use nozzles employing inductive suction for transport and/or blast effect. In such systems, purge medium flow for effecting fluidized transport of the particles is one of the most important factors in an inductive type nozzle for transport and blast treatment effect. Therefore, the control and amount of the purge medium is not only necessary for correct efficient particle making, treatment and transport, but also for correct operation of the inductive nozzle for transport and the operation of a final nozzle for blast effect.

Prior art continuous systems comparable to the present invention are usually operated under partially or wholly unsealed ambient pressure conditions and as a result suffer from inefficiency and high equipment and skilled operator labour costs, which, are caused by agglomeration and plugging arising from humidity intrusion and system pressure imbalance, which requires delicate adjustment to correct system pressure and flow imbalance. In practice, high power and labour intensive mechanical equipment such as sealing arrangements, airlocks, vibrators, pumps and alpha radiation have been used in an attempt to correct these deficiencies but, as with efforts to seal part of the system in order to increase system efficiency, have only created further complexity and cost. Consequently, there is a need for a simplified system that can reduce mechanical, capital and operational costs while preserving the integrity of the solids by means of integrating isolated particle production, sizing and fluidizing.

Prior art systems employing positive pressure have been limited to partially sealed or individually sealed sub-systems or batch operation, agitation, prevention of clogging or short distance fluidization as typified in U.S. Pat. Nos. 4,048,757 and 5,071,289.

BRIEF SUMMARY OF THE INVENTION

According to the present invention, a fluidized particle production system has a solidifying unit with a solidifying surface for supporting a solidified layer of a solidifiable medium and a treatment apparatus for removing the solidified medium from the solidifying surface and sizing the removed solidified medium into particles of desired dimensions. The treatment apparatus comprising a sizing device co-operating with the solidifying surface for effecting therebetween the sizing of the particles. Adjacent portions of the solidifying surface and the sizing device are displaced together with one another so that the particles are formed without grinding the solidified medium. A housing, which is preferably sealed, encloses the solidifying unit and the treatment apparatus and has an outlet duct communicating with the interior of the housing, and at least one sweep fluid outlet positioned to discharge a flow of sweep fluid into the housings preferably in the vicinity of the sizing device, for fluidizing the particles and transporting the fluidized particles through the outlet duct. A sweep fluid supply source is connected to the outlet and a valve between the source and the outlet controls the pressure and flow of the fluid at the outlet.

The present invention may be employed to create particles made from solidfiable media, such as water, additives (solid or liquid), organic solvents, plastics and any other materials that can be solidified into a handleable friable form. Once produce:d, the particles may be suitably cooled or further cooled and fluidized in the sweep fluid, which may be either a gaseous or liquid media, to produce a free-flowing finished particle of a desired size suitable for either ambient or elevated pressure transport and also surface blasting. The present invention is useful for operation together with transportation ducts, boosting accelerators (in the case of long distance or pneumatic transport pressure resistance), and discharge blastheads (in the case of blast cleaning and treatment). It is preferable but not necessary that the boosting accelerators and discharge blastheads utilize an effective type nozzle, as disclosed in my co-pending patent application Ser. No. 08/203,584, filed Mar. 1, 1994, the disclosure of which is incorporated herein by reference. In such a nozzle there is placed within a main nozzle housing a blast nozzle through which high pressure blast media is delivered to a main conduit of the main nozzle housing. As a result of decompression of the high pressure blast media following discharge from the blast nozzle, a conical flow front is formed, which extends into a constrictive nozzle throat of a discharge end of a nozzle housing and which forms a powerful effective nozzle. This effective nozzle arrangement not only provides a stronger, more controllable induction and improved energy transfer to accelerate the particles, but also provides means to further fracture and size transported particles for better acceleration.

The system according to the present invention is useful for enhancing blast performance in blast cleaning systems that use inductive type nozzles which are limited in inductive vacuum for particle transport and are sensitive to imbalance, either in stopping or starting, or in continuous operation. and also preferably in discharge blastheads employing such effective nozzles.

The solidifying unit is capable of producing friable solids and, in the case of particulate ice, may take the form of a conventional ice-making unit. With regard to other friable solids, the invention may be used with other known apparatus which create solidified particles, e.g. moving belt surfaces, spray and flash dryers and preening columns.

In respect of particulate ice, and with the appropriate adjustments, the treatment unit may work in conjunction with several types of conventional ice making units, including horizontal drum, vertical drum and disc-style ice-making units. In a horizontal drum ice-making unit, there is a fixed or variable speed rotating drum having a solidifying or forming surface on which water is frozen. The water may be applied onto the drum by spraying or flooded wiers, or the drum may be partially immersed in the water. Preferably, with the horizontal drum configuration, the water is first applied at some distance, in the direction of the rotation of the drum, from the point where the ice is harvested. This allows adequate pre-cooling of the drum surface and a suitable period for efficient freezing of the water. As the drum is rotated, the water forms a solidified layer of ice. Additional water may be applied later in the rotation cycle to increase the ice layer thickness. However, a zone before the treatment apparatus is preferably reserved for post-cooling after solidification to enhance the friability and handleability of the ice. The circumferential lengths of these zones depend upon the conditions required to make a suitably friable ice. For the case of water ice used for blast cleaning, the post-cooling zone facilitates the production of hard clear friable ice rather than normal "wet" ice, and best use of the sweep fluid. Similarly, for other singular or combined solidifiable media, to obtain hardness and friability by cooling, evaporation or curing, the same requirements apply.

alternatively, prior art apparatus comprising a vertical drum ice-making unit or one of more rotating discs (not shown) can be used, the water being applied to the outer surface of a motor-driven drum, to disc surfaces or to the inner surface of a fixed drum, as the case may be. While the use of the horizontal drum is preferred, because of its geometric arrangement and space saving features, it will be apparent to those skilled in the art that any type of ice-making or solidifying unit may be employed in the present invention.

In the case, particularly, of the horizontal rotating drum, or the disk style ice making unit, application of the water may be affected by partial immersion of the solidifying or forming surface(s). However, for purposes of stopping and starting it is preferred that the water be applied by means of spray manifolds or wiers. These have the advantage of more practical control of both the thickness and the hardness of the ice layers by positioning and applying the ice at one or more application points. Such application also simplifies that control and facilitates conditions for start up, particularly where off-line or idle system conditions are required for practical operation.

In a preferred method, for simplicity and flexibility in stopping and starting the process, the dryness and coldness of a sealed system incorporating the present apparatus may be preserved by not holding the solidifiable medium in an immersion sump, by maintaining a low operational temperature and by controlling the application of the material to be solidified. Heat tracing of distribution lines and, if necessary, a return sump may be easily effected by means known in the art for either ambient or pressure conditions.

The treatment unit is located close to the solidifying unit, both of which are contained within the sealed housing. If pressurized, the housing may be of a common pressure vessel design and may allow for practical access and overpressure protection. Gaskets and seals may be installed to prevent pressurization loss and also air and moisture leakage into the housing. The housing is effectively sealed to encourage a high production rate of ice having a high quality of clarity, hardness and friability and to allow for an efficient use of sweep air. High quality cold dry air may be used as the sweep air and under pressurized conditions may be used to augment the performance of a boosting accelerator or a discharge blasthead.

The treatment unit preferably comprises a harvester, a sizer, and sweep medium distribution manifold. The sizer is positioned after the harvester in the direction of movement of the solidifying surface. The profile of the surface of the sizer may comprise a plurality of patterned and regularly spaced teeth designed to produce particles of a desired uniform size. and may also include a profile suitable for harvesting the ice, in which case the harvester may be omitted. Fluidized dislodging by the sweep fluid assists in both keeping the sizer clear, and also for transport of the particles. The fluidizing media may be the same as the sweep media as a gas for pneumatic operation or a liquid such as a liquified gas or a combination of both. Either or both media may also be used to control the transport flow and pressurization of the enclosure for improved performance in transport and blast effect as described above, particularly when used with an effective type nozzle.

The harvester can take the form of a fixed blade, which may be toothed, a rotating roller, which may be of helical form to fracture or scrape the solidified medium from the solidifying surface. The harvester may either be articulating or freely rotating or indexed to the solidifying surface, but in any case will be positioned to contact the solidified medium and not the solidifying surface. The chief function of the harvester is to fracture the solidified layer into large chunks or flakes for subsequent sizing.

The sizer may take the form of a roller sizer having a profiled surface that fractures and releases friable material away from the solidifying surface.

For simplicity and better effect in transporting it has been found that the sizing device may be a sizing roller positioned next to the moving solidifying surface of the solidifying unit so that a double roller-like assembly is created. In this case, the sizing roller is profiled with spaced teeth or alternatively has a helical or other profile or a combination of forms similar to that of a conventional harvester. The roller may driven by gears, a chain and sprocket or other common means, or actuated by the rotation of the solidifying surface so that its rotation is indexed with the solidifying surface The orientation and position of the sizing roller will depend on the type of solidifying unit used. However, the sizing roller will be placed with a small clearance from the solidifying surface and positioned so that it comes into contact with and penetrates the entire width of the solidified layer so as to fracture and release the solidified layer.

BRIEF DESCRIPTION OF THE DRAWINGS

The invention will be apparent from the following description of embodiments thereof with reference to the accompanying drawings, in which.

THE PREFERRED EMBODIMENTS

Figure 1:
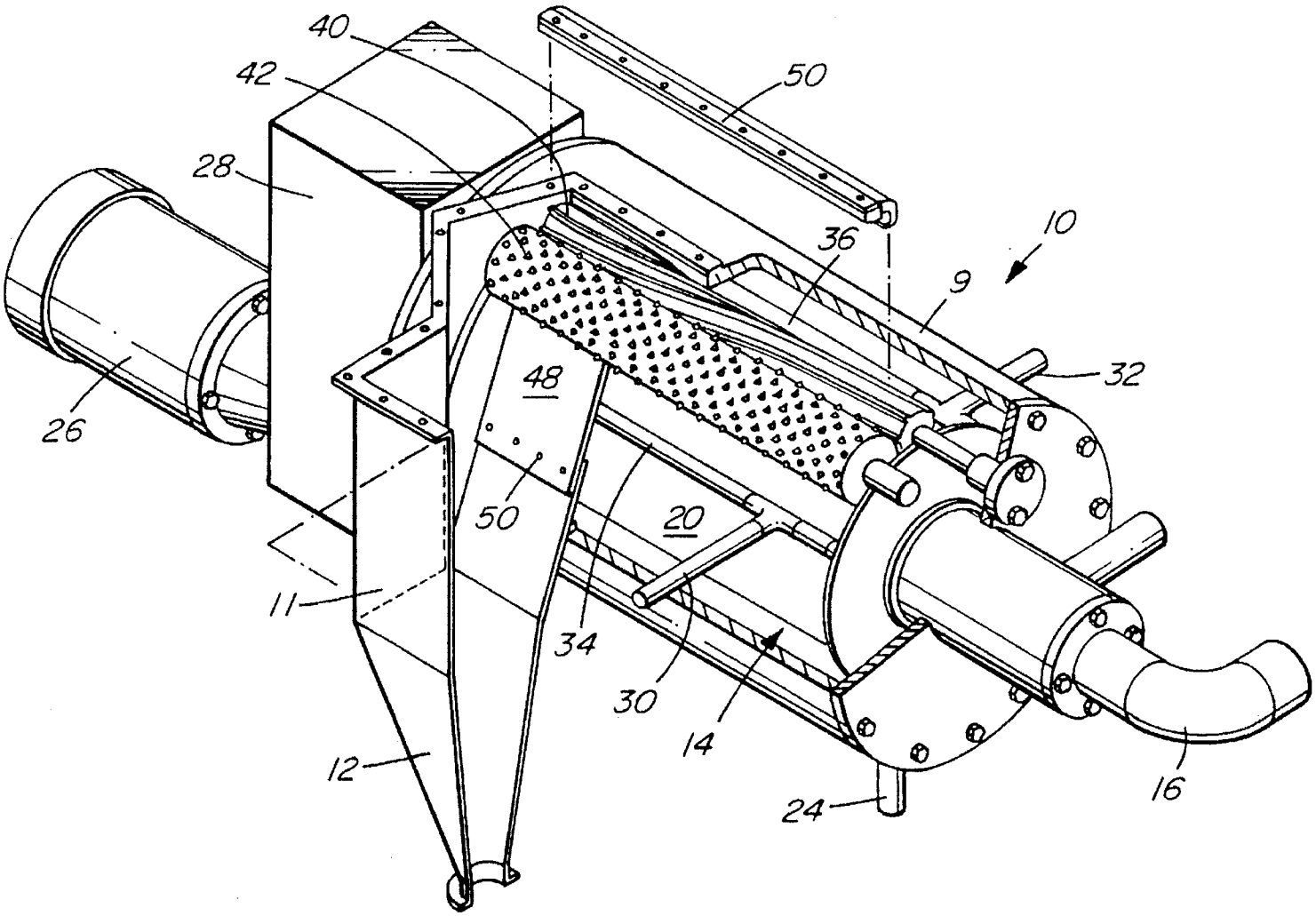
FIG. 1 shows a partially-broken away view in perspective of a sealed housing containing a solidifying unit, a treatment apparatus and associated components, according to a first embodiment of the present invention.

As shown in FIG. 1, a sealed housing indicated generally by reference numeral 10 has a cylindrical portion 9 and a lateral extension 11 which communicates with a downwardly convergent outlet duct 12. The housing 10 contains a solidification unit in the form of a horizontal ice- making drum indicated generally by reference numeral 14, the interior of which communicates through a duct 16 with a refrigeration unit 18 (FIG. 3) for cooling a solidifying or forming surface 20 on the exterior of the drum 14.

Figure 2:
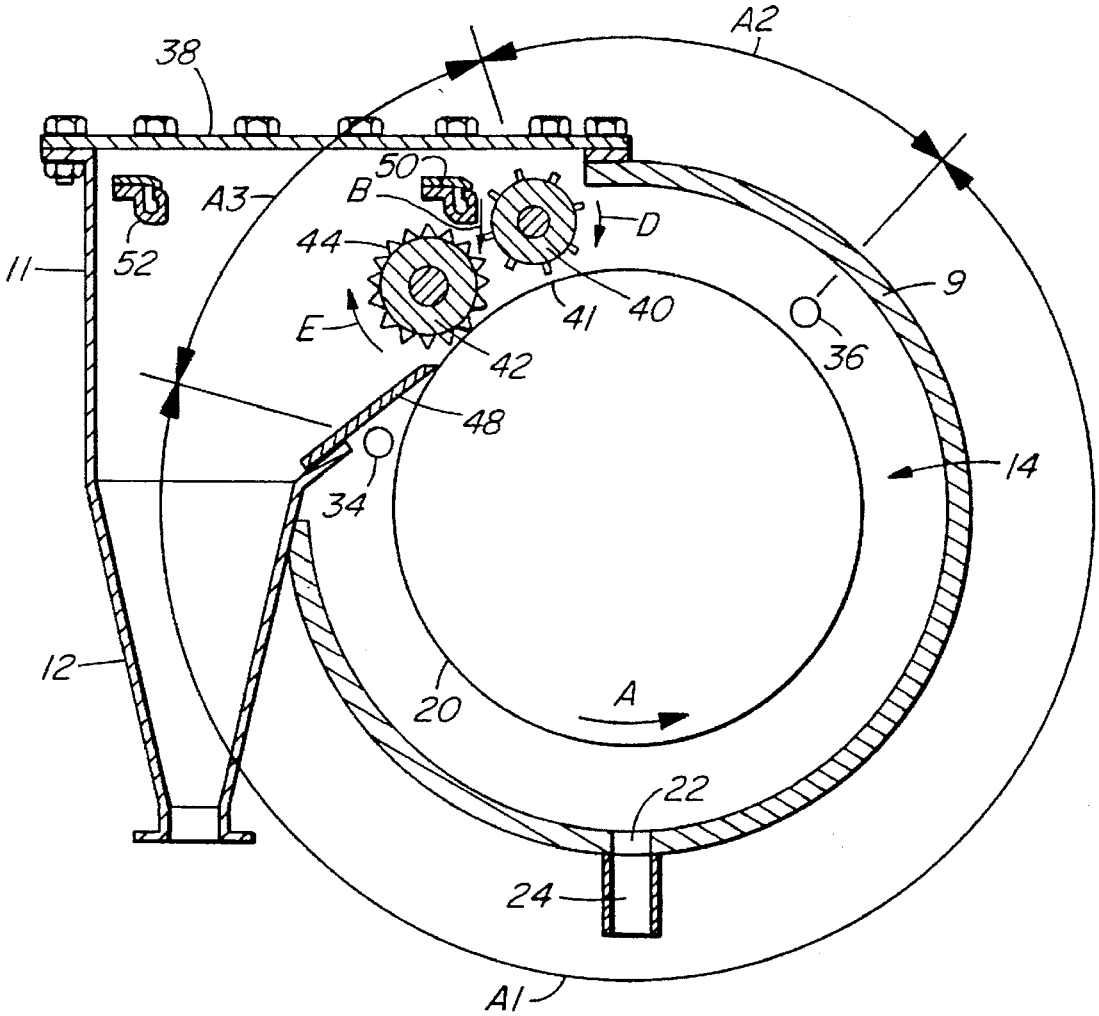
FIG. 2 shows a view taken in transverse cross-section through the apparatus of FIG. 1.

As shown in FIG. 2, the housing 10 is provided at its bottom with a drainage opening 22, which is connected by a drain pipe 24 to a water reservoir 62 (FIG. 3) for recycling water from the drum 14. An electric motor 26 is connected through a reduction gearing 28 to the drum 14 for rotating the drum 14 about its horizontal axis.

Water supply pipes 30 and 32 are connected to perforated spray pipes 34 and 36 which extend parallel to the drum 14 and which serve to spray water onto the surface 20 so as to build up a layer (not shown) of ice on the surface of the drum 14 as the drum 14 is rotated in the direction of arrow A of FIG. 2.

The lateral extension 11 of the housing 10 has an upwardly open top which is closed in an air-tight manner by a cover 38 which is bolted to the housing 10 and the crossing 10 and which can readily be removed to provide convenient access to the interior of the housing 10.

Within the housing 10, a first roller in the form of a helical harvester roller 40 is spaced from the drum surface 20 by a gap 41 which, effectively, forms a nip between the harvester roller 40 and the drum surface 20.

The harvester roller 40 is followed, in the direction of rotation of the drum 14, by a sizer roller 42, which likewise extends parallel to the drum 20 and which is formed on its exterior, in known manner, with a plurality of spaced projections 44, which are spaced and dimensioned to produce, in co-operation with the drum surface 20, fluidizable ice particles of desired dimensions.

Beyond the sizer roller 42 in the direction of rotation of the drum 14, a doctor blade 48, which is secured by screws 50 to the housing extension 11, extends in close proximity to the drum surface 20 at a location almost immediately following the sizer roller 42.

A first air outlet in the form of an air discharge manifold 50 extends parallel to the rollers 40 and 42 and is located close to the rollers 40 and 42 for directing a discharge of sweep air at the roller 42 and between the rollers 40 and 42, as indicated by arrow B, to the outlet duct 12.

A second air outlet in the form of an air discharge manifold 52 extends parallel to the manifold 50 and is provided directly above the outlet duct 12 for directing a flow of air in the direction of arrow C towards the outlet duct 12.

The spray pipe 34 is disposed closely below the doctor blade 48 for discharging water onto the drum surface 20. Major solidification of this water to form a frozen layer of ice (not shown) on the drum surface 20 then takes place in a zone defined by an arc A1 extending from the pipe 34 to the pipe 36. It is to be understood that, while water is solidified by freezing in the present embodiment of the invention, different media may be solidified by other means, such as curing or evaporation. Further water is sprayed by the pipe 36 onto the drum surface 20, and final solidification of the ice layer then takes place over a zone defined by a second are A2 from the pipe 36 to the gap 41.

At the gap 41, the harvester roller 40, in cooperation with the drum surface 20, fractures the ice layer into ice flakes.

These ice flakes are crushed between the sizer roller 42 and the drum surface 20 so as to form ice particles of the desired shape. The sizer roller 42 and the drum 14 therefore act as a counter-rotating roller pair forming therebetween a nip at which the ice particles are formed. More particularly, the sizer roller 42 is rotated by the motor 26 and the speed reduction gearing in timed relation to the rotation of the drum 14 so that adjacent portions of the periphery of the sizing roller 42 and of the drum surface are moved together with one another, i.e. in the same direction and at the same speed. In this way, the ice flakes are crushed but not ground between these adjacent portions, thus counteracting the formation of ice particles which are too small. These ice particles are then swept past the sizing roller 42 by the air flow from the air discharge manifold 50 over the doctor blade 48 and into the outlet duct 12.

Over a zone defined by an arc A3 extending from the gap 41 to the pipe 34, the ice layer is thus removed from the drum surface 20 and the drum surface is prepared by the doctor 48 to receive a new layer of ice. Excess water discharged from the pipes 34 and 36 and not formed into ice particles is collected by the housing 10 and passes through the drain 22 and the drain pipe 24.

The harvester roller 40 may be indexed to the drum 14 for rotation in timed relationship therewith, in the directions indicated by arrows D, by the reduction gearing 28, but may alternatively be freely rotatable.

The air discharge manifold 52 may be omitted in cases where it is found that the air discharged by the manifold 50 is sufficient to effect the fluidizing and transport of the ice particles from the gap 46.

However, the manifold 52 or other transport and fluidizing inputs (not shown) may also be used to provide fluid flow for desired pressuring action of the housing 10 through the control valves 74, 75, 76 (FIG. 3) in order to improve the transport and blast effect.

The height of the projections 44 of the sizing roller 42 is proportional to the thickness of the ice layer on the drum surface 20, which for the purposes of ice-blast cleaning is preferably in the range of 1/16" to 3/16". The spacing between the projections 44 should be in the same range and the sizer roller 42 is preferably located so that the tips of the projections 44 are at least 1/32 of an inch from the drum surface 20. This arrangement is suitable for fracturing the ice layer formed on the drum surface 20 and then lifting the resulting particles away from the drum surface 20 with minimum amounts of "snow" generated by pulverizing the ice. Any fractured chunks or flakes of ice which are not released from the drum surface 20 in this way are removed by the doctor blade 48, which comprises a non-abrasive scraper such as an aquaphobic plastic knife.

To avoid the production of "snow", further reduction of particle size, if required for better effect in blast cleaning, may be effected after transport of the particles from the outlet duct 12 and by means e.g. of an effective nozzle blast head as disclosed in co-pending patent application Ser. No. 08/203,584, filed Mar. 1, 1994.

In any event, the profiles of the harvesting and sizing rollers are designed to produce high quality cold dry particles suitable for fluidized storage, transport and subsequent sizing if required for improved blast cleaning effect.

The harvester roller 40 may be omitted. When the harvester roller 40 is provided, it has the advantage that it contacts the ice and releases the ice from the drum surface 20. However, the harvester roller 40 has the disadvantage that it produces large, randomly shaped ice flakes which must be re-broken to the desired particle size and which must be matched to the capacity of the sizer roller 42 without the production of too fine ice particles, which could result in plugging of the apparatus.

When the harvester roller 40 is omitted, the periphery of the sizer roller 42 may be designed with a suitable profile to produce the desired particle size by fracturing and sizing the ice in one step, thus combining sizing and harvesting.

Generally speaking, the smaller the particles formed or sized, the greater the difficulty in preventing fines built-up. A profiled harvester/sizer will normally remain clear of particles provided that they are non-adhering e.g. in the case of water ice, dry and cold will be defined by brittle fracture upon removal from the forming surface, and the treatment surfaces will best be aquaphobic. If required, the profiled sizer/harvester may be in addition mechanically cleaned by means such as a stiff brush using, e.g. in the case of water ice, aquaphobic bristles such as nylon or the like, e.g. as described in greater detail below with reference to FIGS. 4 and 5 or by a serrated fixed blade suitably fixed in proximity to the sizer and harvester rollers. Fixed blades operating on a forming surface have worked and are known in the art, but produce "shaved" fines and do not produce discrete sized particles and therefore have no useful value for blasting and cause agglomeration, build-up and transport problems. For purposes of particle production, fixed blades are better used to scavenge those ice portions not previously removed.

The present apparatus uses internal stresses in the ice layer to fracture uniform sizes rather than scraping, grinding or milling. The fracturing should be effected with minimum relative velocity, and by pressure applied by profiled shapes so that the natural brittleness and the expansion or contraction of the material will free it from both the drum surface, and also the harvester and sizer rollers. Fracture and sizing should be via directed forces in a pattern to produce desirable particle sizes, using the internal stresses of the solidified ice, rather than high power from the sizing roller. Consequently, prior art double profiled rollers and impact mills are less effective than the present apparatus.

The initial function of the sweep air from the manifold 50 is to dislodge the large ice chunks or flakes and sized particles from the drum surface 20, harvester and sizer rollers 40 and 42 and the walls of the housing 10. It is preferable that the sweep air be pressurized. In addition to the advantages of over pressuring the ice-making unit for humidity control, the pressurization improves the quality and density of the ice formed in the ice-making unit by minimizing the formation of air bubbles within the ice, and aids in the sealing of the system (by excluding any leakages). In addition, pressurization provides a driving force for sweeping and fluidizing the ice particles, for transport to the outlet duct 12 and for overcoming longer transport duct resistance to the booster accelerator or discharge blasthead, if included. Pressurization also improves accelerator booster and discharge blasthead performance, where final discharge is controlled by a constriction such that transport velocities within the transportation duct are kept low to prevent particle degradation. In the case of eductor type nozzles which rely on low suction pressures, pressurization can create a large positive pressure gradient, thereby increasing the driving force, behind the particulate flow.

It is important to note that pressurization of the solidifying system and transport does not imply velocity in the transport duct or hose. Velocity and associated attrition and heat build up may be controlled through mechanical, or more simply, pneumatic restrictions generated by transport boosters or blast heads. The effective nozzle disclosed in my above-mentioned co-pending patent application Ser. No. 08/203,584, offers improved system controllability.

The sweep air pressure within the sealed housing 10 with correct sweep air control may have a pressure as low as 0 psig, which is adequate for pre-cooling of the entire system and transport duct, and cooling of the particles and will allow for a cost-effective low pressure vessel housing design. However, pressures equal to or greater than 50 psig should be used for an optimal blast cleaning effect. The sweep air should have a low humidity and temperature so as to maintain the hardness and dryness of the ice particles formed. In the case of where the ice formed requires further cooling, the humidity and temperature should be maintained to facilitate friability. The high cost of cool and dry sweep air may be reduced by using lower quality accelerating air at the booster accelerator and discharge blasthead. In addition, somewhat higher humidity and temperature sweep media may be used to reduce overall power consumption of the system if the ice is produced at low temperatures of −10° C. or lower. For ice production at these temperatures, the sweep air need only be dehumidified to the pressure dew-point temperature of the water in order to reach acceptable conditions of friability, cooling, fluidization and transportation. Gases other than air normally do not require dehumidifying. Dehumidification of air may take place by treating compressed sweep air (100–150 psig) with filters and traps for the removal of particulates and oil, and normal air/air or air/water after-coolers for initial dehumidification. Final drying, if required, may be completed in two steps. First, the sweep air will be cooled to just above the freezing point of water and dried by a refrigerated heat exchanger, which will remove virtually all of the water content. All the above-described treatment equipment is known in the art. Alternatively, desiccant dryers or vortex tubes may be used. A final heat exchanger will cool the air to −18° to −12° C. Upon release of this pressurized dehumidified air within the sealed housing, the air will expand and reach even lower temperatures compatible with ice formation, further cooling of the ice particles and counteracting heat intrusion into the entire system and during transport.

The pressure, temperature and humidity ranges described above provide smoothness of flow and prevent agglomeration and plugging. Variation of the positive pressure gradient between the solidifying unit and booster accelerator or discharge blasthead may be carried out by modulation of the sweep air input into the sealed housing and its resulting pressure or by an adjustable fluidized pneumatic restriction located at juncture of the treatment unit and transportation duct, the modulation of an effective nozzle, or a combination of all.

In the case of blast treatment, flow of the ice particles may be precisely controlled and optimized mechanically or pneumatically with the effective type nozzle. The ice making rate can be varied by modifying the speed of the forming surface 20, the supply and temperature of the refrigerant or the rate of supply of water to the drum surface 20. Alternatively or conjunctively, the relative downstream pressure in the transportation duct may be varied, as described, against the effect of the sweep air pressure or the pneumatic restriction, or the booster or accelerator, thereby further expanding the range of operational flow rates possible.

Figure 3:
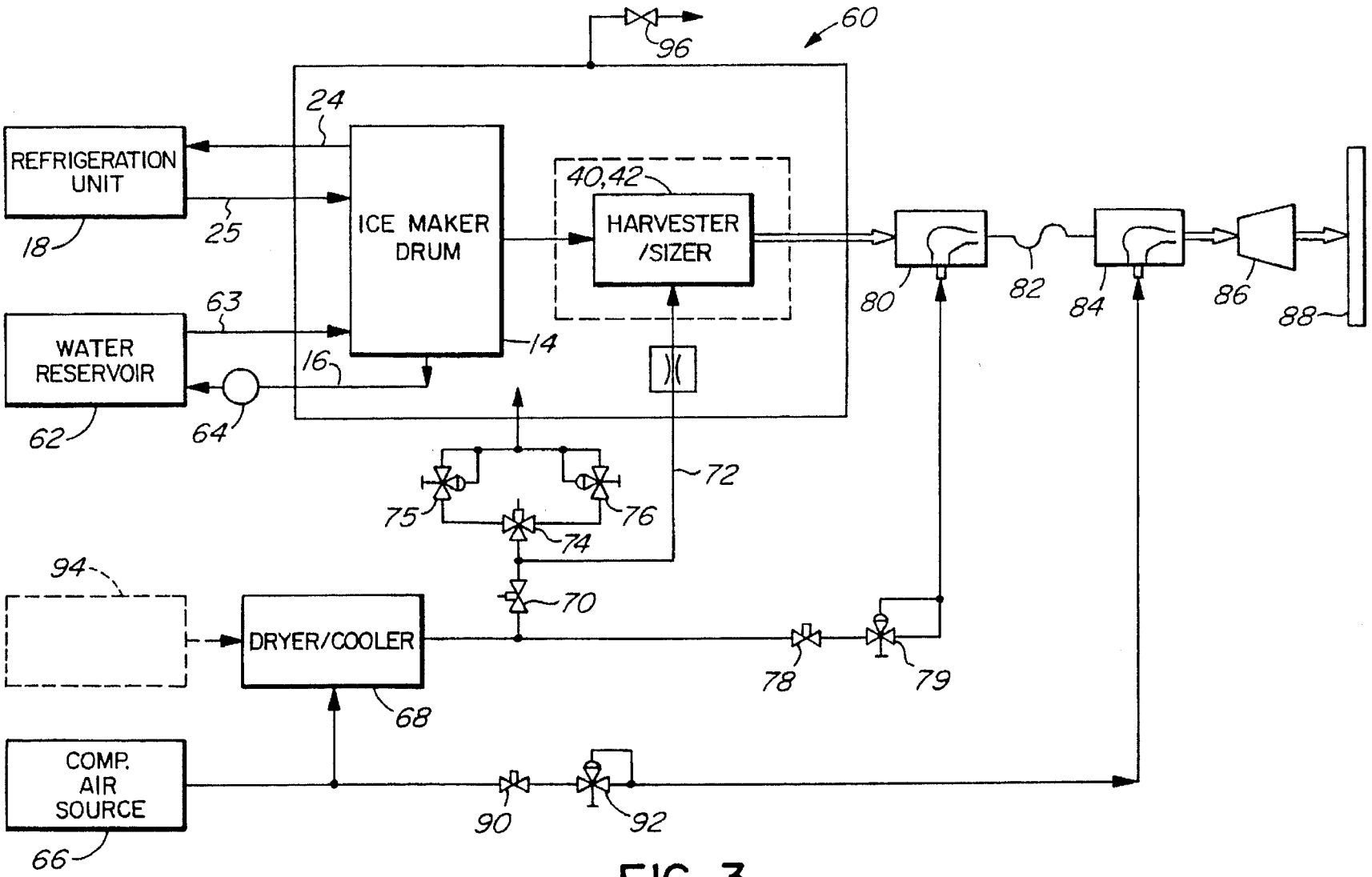
FIG. 3 shows a block diagram of an ice particle production and blasting system incorporating the apparatus of FIGS. 1 and 2.

Referring now to FIG. 3, which shows a block diagram of a blast cleaning system, a fluidized particle production system according to the present invention, and indicated generally by reference numeral 60, represents diagrammatically the fluidized particle production system shown in FIGS. 1 and 2.

The ice making drum 14 is shown in FIG. 3 as being connected to the refrigeration unit 18 by pipes 24 and 25. The spray pipes 34 and 36 are connected to a water reservoir 62 by a pipe 63 for supplying water from the water reservoir 62 to the drum 14 and the drain pipe 16 returns excess water from the drum 14, through a liquid-only flow limiter 64, similar to a steam condensate trap, to the water reservoir 62.

A compressed air source 66 is connected through an air dryer and cooler 68 and through a manual or automatic ON/OFF valve 70 to the particle production system 60. More particularly, the valve 70 is connected through a line 72 to the air discharge manifold 50, and through a two-way RUN/IDLE valve 74, a RUN valve 75 and an IDLE valve 76 to the manifold 52. By manual adjustment of the valve 74, the compressed air from the compressed air source 66 can be supplied through the valve 75 while the system is in operation for producing particles, and through the valve 76 while the system is idling. The valves 75 and 76 are manually adjustable to pre-set and then automatically control the pressure and flow supplied to the air outlet manifold 52, and therefore the resulting pressure in the housing 10.

The air dryer and cooler 68 is also connected through an ON/OFF valve 78 and an adjustable pressure control valve 79 to an accelerator 80.

The purpose of the accelerator 80 is to accelerate the fluidized stream of particles supplied from the outlet duct 12 through a transport hose 82 to a blasthead 84, from which the particles are discharged through an outlet nozzle 86 for impact against a target surface 88. The arrangement of the accelerator 80, the blasthead 84, the outlet nozzle 86 is described in greater detail in the above-mentioned co-pending patent application Ser. No. 08/203,584, and is therefore not further described herein.

The purpose of the dryer/cooler 68 has been described. In some cases, the dryer/cooler 68 may be omitted, and process air may then be supplied via another source 94.

Also, in cases where transport through the hose 82 is adequate, particularly where the housing is pressurized, the accelerator 80 and its motive fluid supply from dryer/cooler 68 may not be required.

Compressed air from the compressed air source 66 is supplied to the blasthead 84 through an ON/OFF valve 90 and a pressure control valve 92. An alternative compressed air or other fluid source 94 may, if desired, be employed to supply to or replace the air dryer and cooler 68. The particle production system 60 is provided with an overpressure safety relief valve 96 for venting the housing 10 to the atmosphere in case an excess pressure occurs within the housing 10.

Figure 4:
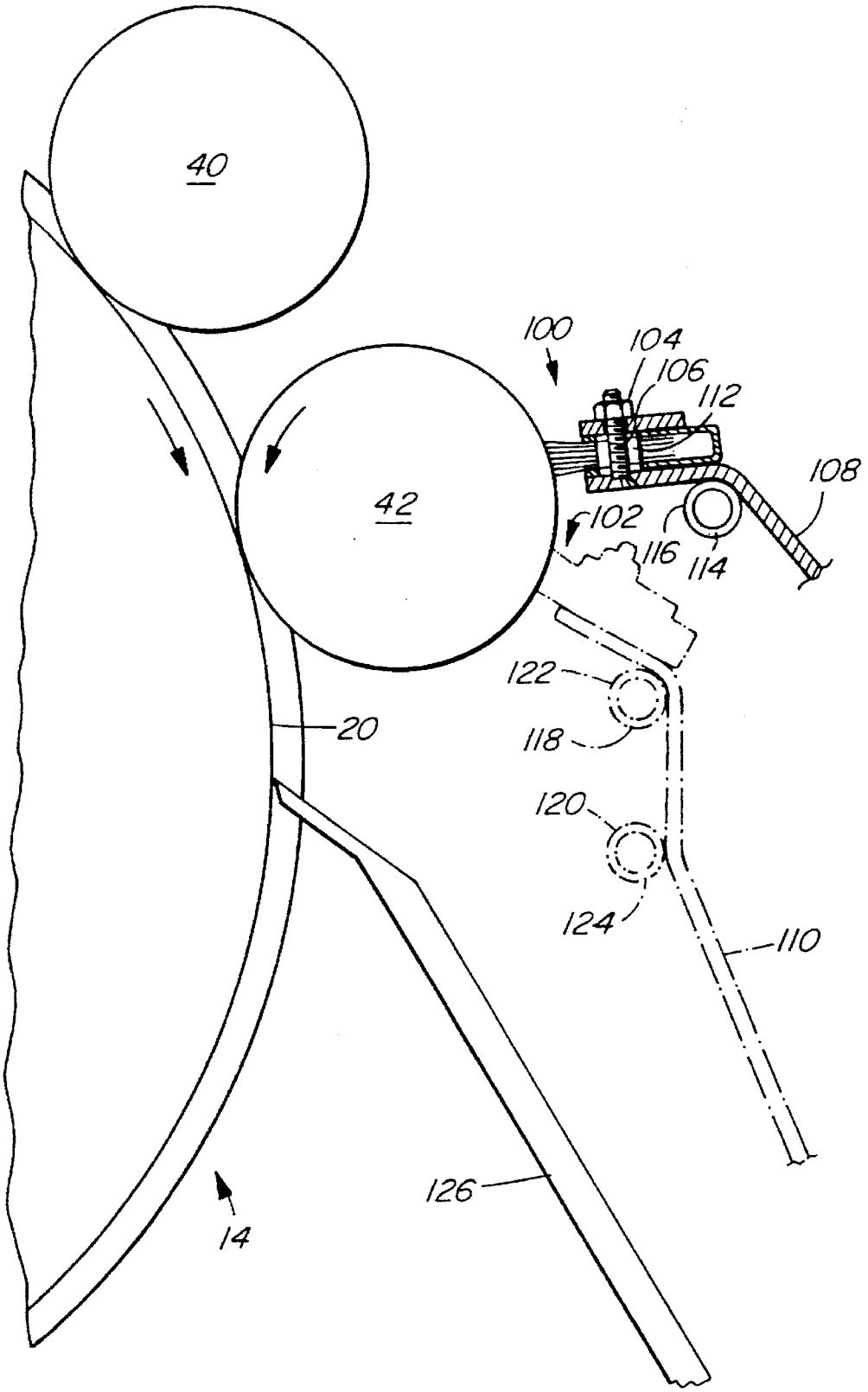
FIG. 4 shows a broken-away view in transverse cross-section through parts of a modification of the apparatus of FIGS. 1 and 2.
Figure 5:
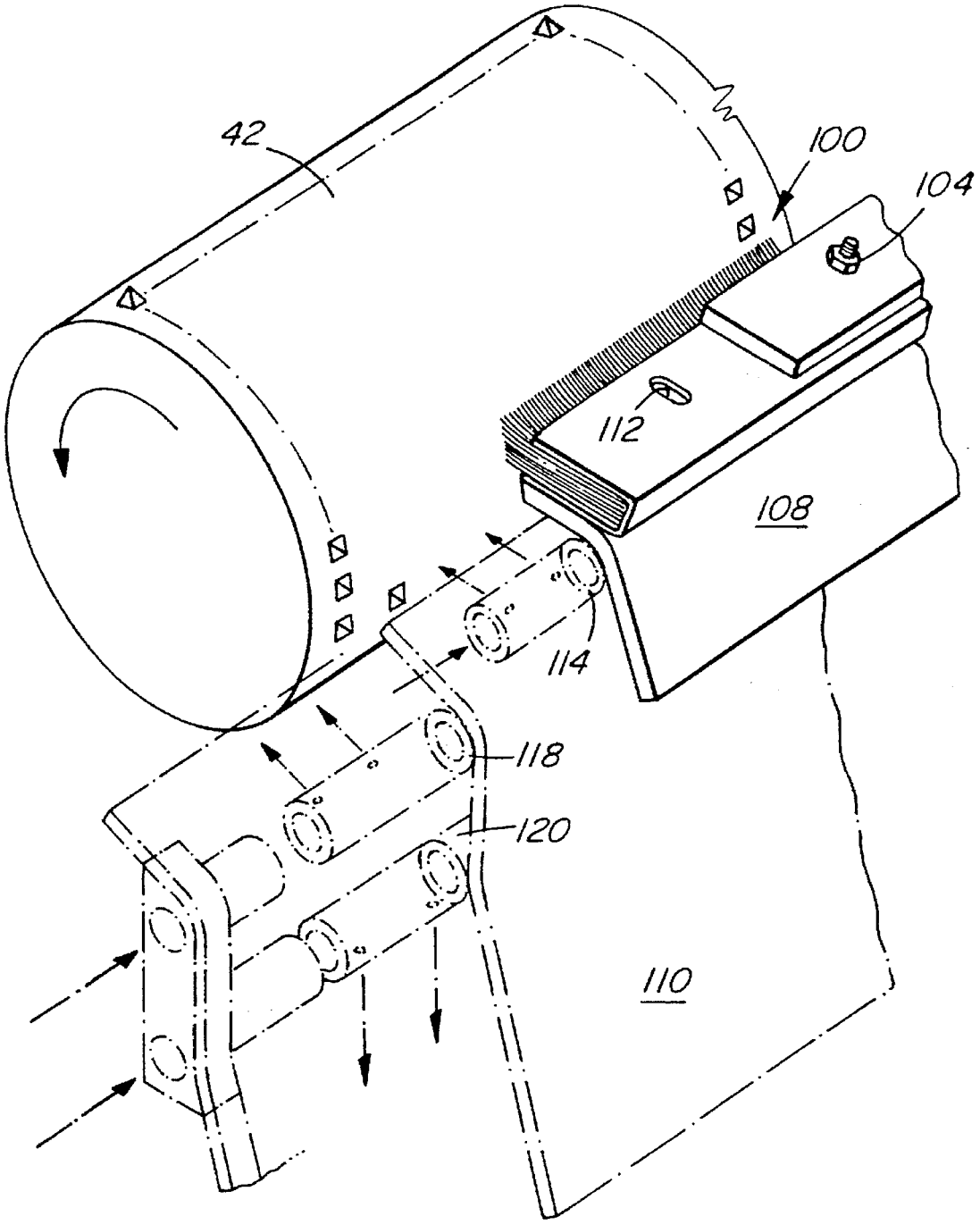
FIG. 5 shows a broken-away view in perspective of parts of the apparatus of FIG. 4.

FIGS. 4 and 5 show a modification of the apparatus illustrated in FIGS. 1 and 2. As shown in FIGS. 4 and 5, a brush indicated generally by reference numeral 100 is mounted in proximity to the outer surface of the sizer roller 42, with the bristles of the brush 100 brushing against the roller surface for removing any pieces of ice remaining on the parts of the surface of the roller 42 which have rotated beyond the location at which the ice particles are formed. The brush 100 is secured by nuts 104 and bolts 106 to a support plate 108. As can be seen from FIGS. 4 and 5, the brush 100 is provided with an elongate slot 112 through which the bolt 106 extends, so that the brush 100 can be adjusted in position relative to the sizer roller 42 and then secured by tightening of the nut 104. The brush 102 is likewise adjustable in position relative to the sizer roller 42.

Beneath the support plate 108, there is provided an air outlet manifold 114 in the from of a perforated pipe having outlet openings 116 directed towards the sizer roller 42.

Any ice still remaining on the surface of the sizer roller 40 after the sizing of the ice between the sizer roller 42 and the drum 14 may then be dislodged by the air discharged from the air outlet manifold 114 and by the brush 100, and is then guided by the support plate 110 towards the outlet duct 12.

Alternatively, the brush 100 may be replaced by a brush 102 mounted on a support plate 110, which are shown in broken lines in FIGS. 4 and 5.

Beneath the support plate 110, there are provided two air outlet manifolds 118 and 120. The air outlet manifold 118 has outlet openings 122 directed towards the sizer roller 42, whereas the air outlet manifold 120 has outlet openings 124 directed towards the outlet duct 12. The ice particles, and also ice remaining on the portion of the surface of the sizer roller 42 which is moving beyond the drum surface 14, are fluidized by air blasts from the outlet openings 122 of the air outlet manifold 118. The air from the air manifold 120 then assists the movement of these particles towards the outlet of duct 12.

As can be seen from FIG. 4, a scraper blade 126 replaces the doctor 48 of FIG. 2, and serves to guide the ice particles towards the outlet duct 12.

The brushes 100 and 102 may, if desired, be replaced by suitable profiled scraper plates of aquaphobic material. Likewise, the scraper 126 is preferably formed of a slick, aquaphobic material to counteract the deposition of the ice particles on the scraper 126.

It will be understood from the foregoing description and apparent that various modifications and alterations may be made in the form, construction and arrangement of the parts thereof without departing from the spirit and scope of the invention as defined by the appended claims, the forms herein described being merely preferred embodiments thereof.

I claim:

1. A fluidized particle production system, comprising:

a solidifying unit for solidifying a solidifiable medium;

said solidifying unit having a solidifying surface for supporting a solidified layer of the medium and a drive for displacing said solidifying surface;

a treatment apparatus for removing the solidified medium from said solidifying surface;

said treatment apparatus comprising a sizing roller co-operating with said solidifying surface, said sizing roller having peripheral projections co-operating with said solidifying surface and said sizing roller being located sufficiently close to said solidifying surface to define therewith a nip dimensioned to form the solidified layer on said solidifying surface into fluidizable particles as said solidifying surface advances past said sizing roller;

a sealed housing enclosing said solidifying unit and said treatment apparatus;

an outlet duct communicating with the interior of said housing;

a sweep fluid outlet positioned to discharge a flow of the sweep fluid between said sizing roller and aid solidifying surface and towards said outlet duct for fluidizing said particles and transporting the fluidized particles through said outlet duct; and sweep fluid supply source connected to said outlet.

2. A fluidized particle production system as claimed in claim 1, wherein said treatment apparatus includes a harvester roller co-operating with said solidifying surface for fracturing therebetween the solidified layer on said solidifying surface.

3. A fluidized ice particle production system, comprising an ice forming unit for freezing water, said ice forming unit including a drum and a refrigeration apparatus for cooling said drum, said drum having an ice forming surface, a water outlet for discharging water onto said ice forming surface, a water supply connected to-said-water outlet, a sizing roller defining with said solidifying surface a nip, a drive connected to counter-rotate said drum and said sizing roller, said nip being dimensioned to form the ice into fluidizable particles, a sealed housing enclosing said ice forming unit and said sizing roller, a fluidized ice particle outlet duct communicating with the interior of said housing, a gas outlet located within said housing for directing a flow of gas through said nip towards said outlet duct for fluidizing the ice particles and transporting the fluidized ice particles through said outlet duct, a source of compressed gas for supplying the gas under pressure to said gas outlet and a valve between said source and said gas outlet for controlling the pressure of the gas.

4. An ice particle production system as claimed in claim 3, further comprising a doctor blade extending in proximity to said ice forming surface beyond said sizing roller in the direction of rotation of said drum.

5. An ice particle production system as claimed in claim 3, further comprising a harvester roller co-operating with said drum, at a location before said sizing roller in the direction of rotation of said drum, for fracturing the ice on said forming surface.

6. An ice particle production system as claimed in claim 3, including a further gas outlet located within said housing for directing a flow of gas towards said outlet duct to assist the transportation of the fluidized ice particles.

7. An ice particle production system as claimed in claim 3, further comprising a brush co-operating with said sizing roller for brushing ice therefrom.

8. An ice particle production system as claimed in claim 3, including a further gas outlet directed against said sizing roller for dislodging ice therefrom.

9. An ice particle production system as claimed in claim 8, further comprising a brash cooperating with said sizing roller for dislodging ice therefrom.

10. An ice particle production system as claimed in claim 9, wherein said further gas outlet is located beneath said brush and wherein a guide plate is provided for directing the dislodged ice towards said outlet duct.

11. A process for the production of fluidized ice particles, comprising the steps of:

freezing water on a peripheral surface of a rotating drum to form a layer of ice on the surface;

crushing the ice in a nip between the drum surface and a sizing roller to form fluidizable ice particles;

enclosing said drum and said sizing roller in a sealed enclosure;

supplying a flow of gas at a controlled pressure to the interior of said enclosure;

discharging the gas through the nip towards an outlet from said enclosure and thereby fluidizing the particles and transporting the fluidized particles from said enclosure.

12. A process as claimed in claim 9, which includes fracturing the layer of ice on said surface at a further nip between said drum and a harvester roller prior to the crushing of the ice.

13. A process as claimed in claim 11, in which the layer of ice has a thickness, as it reaches the nip between the drum surface and the sizing roller, which is within the range of 1/16–3/16.

* * * * *